US007367896B2

(12) United States Patent
Jackson

(10) Patent No.: US 7,367,896 B2
(45) Date of Patent: May 6, 2008

(54) UNIVERSAL PUTTER

(76) Inventor: George W. Jackson, 1535 Lakeshore Road East, Apartment 1107, Mississauga, Ontario (CA) L4E 3E2

( * ) Notice: Subject to any disclaimer, the term of this patent is extended or adjusted under 35 U.S.C. 154(b) by 142 days.

(21) Appl. No.: 10/873,248

(22) Filed: Jun. 23, 2004

(65) Prior Publication Data

US 2004/0229712 A1 Nov. 18, 2004

Related U.S. Application Data

(63) Continuation-in-part of application No. 10/178,351, filed on Jun. 25, 2002, now abandoned.

(60) Provisional application No. 60/480,741, filed on Jun. 24, 2003.

(30) Foreign Application Priority Data

Jun. 25, 2003 (CA) ..... 2,433,202

(51) Int. Cl.
*A63B 69/36* (2006.01)
*A63B 53/02* (2006.01)
*A63B 53/04* (2006.01)

(52) U.S. Cl. ..... 473/246; 473/248; 473/313; 473/305; 473/340; 473/255

(58) Field of Classification Search ..... 473/244–248, 473/325, 334–341, 305–315, 255; 403/132, 403/133, 137
See application file for complete search history.

(56) References Cited

U.S. PATENT DOCUMENTS 749,174 A * 1/1904 Davis ..... 473/246
1,982,087 A 11/1934 Wantz
D137,283 S * 2/1944 Jakosky ..... D21/734
2,702,060 A 2/1955 Bonnesen
2,708,579 A 5/1955 Hugman
3,042,405 A 7/1962 Solheim
3,102,726 A 9/1963 Barrett
3,909,005 A 9/1975 Piszel
4,073,492 A 2/1978 Taylor
4,111,426 A 9/1978 Goodwin
D252,649 S 8/1979 Bernhardt (Continued)

*Primary Examiner*—Sebastiano Passaniti

(57) ABSTRACT

A putter has an elongated head with a face along a long side of the head and an end surface along a short side of the head. The shaft can be positioned to strike a ball with either the face or the end surface. The end surface may have a loft of 5 degrees or more. The shaft is held in each position such that it does not move appreciably while putting, but can be moved to another position by a golfer, optionally with or without tools. In some embodiments, all contact between the shaft and the head is made through one or more resilient, non-metallic materials such as rubber. In some embodiments, a ball on the end of the shaft is held in a cavity in the head by an annular nut. O-rings or other elements separate the ball from components fixed to the head and the nut can be tightened or loosened to adjust the friction provided by the O-rings or other elements. In some embodiments, the shaft can alternately be made fixable or moveable relative to the head by manipulating, for example twisting, the shaft. In other embodiments, a golfer can change the loft of a face or end of the putter without moving the shaft, by using a wedge that may be removeably affixed to the face or end.

12 Claims, 12 Drawing Sheets

U.S. PATENT DOCUMENTS 4,163,554 A 8/1979 Bernhardt
4,174,108 A 11/1979 Reinholz
4,193,707 A * 3/1980 Doden ..... 403/140
4,194,739 A 3/1980 Thompson
D257,782 S 1/1981 Bernhardt
4,306,721 A 12/1981 Doyle
4,519,612 A 5/1985 Tsao
4,580,784 A 4/1986 Brill
4,647,045 A 3/1987 Bilyeu
4,815,740 A 3/1989 Williams et al.
4,881,737 A 11/1989 Mullins
4,953,867 A 9/1990 Rigsby
5,116,159 A * 5/1992 Kern et al. ..... 403/132
5,176,379 A 1/1993 Reinberg
5,228,689 A 7/1993 Donofrio, Sr.
5,244,205 A 9/1993 Melanson et al.
5,253,869 A 10/1993 Dingle et al.
5,340,104 A 8/1994 Griffin
5,348,295 A 9/1994 Phillips
5,377,979 A 1/1995 Long
5,390,919 A 2/1995 Stubbs et al.
5,390,920 A 2/1995 Nickum
5,407,196 A 4/1995 Busnardo
5,415,399 A 5/1995 Kettelson
5,429,356 A 7/1995 Dingle et al.
5,433,444 A 7/1995 Chiuminatta et al.
5,452,891 A 9/1995 Thomas
5,462,279 A * 10/1995 Culpepper ..... 473/248
5,470,063 A 11/1995 Fisher
5,533,730 A 7/1996 Ruvang
5,542,665 A 8/1996 Levocz et al.
5,564,853 A * 10/1996 Maughan ..... 403/137
5,569,096 A 10/1996 Lee
5,580,051 A 12/1996 Fisher
5,584,769 A 12/1996 Sundin
5,692,969 A 12/1997 Schooler
5,700,206 A 12/1997 Lin
5,709,613 A 1/1998 Sheraw
5,716,287 A 2/1998 Levocz et al.
5,746,664 A 5/1998 Reynolds, Jr.
5,749,790 A 5/1998 Van Alen, II et al.
5,857,920 A 1/1999 Hong
5,863,257 A 1/1999 Busnardo
5,865,687 A 2/1999 Alzano
5,976,025 A 11/1999 Williams
5,993,324 A 11/1999 Gammil
6,001,024 A 12/1999 Van Alen, II et al.
6,056,647 A 5/2000 Tingelstad
6,095,929 A 8/2000 Clark
6,126,555 A 10/2000 Schooler
6,142,884 A 11/2000 Yim
6,203,443 B1 3/2001 Britton
6,213,889 B1 4/2001 Hamburger
6,287,215 B1 9/2001 Fisher

* cited by examiner

UNIVERSAL PUTTER

This is a continuation-in-part of U.S. Ser. No. 10/178,351, filed Jun. 25, 2002, now abandoned, and an application claiming the benefit under 35 USC 119(e) of U.S. Ser. No. 60/480,741, filed Jun. 24, 2003. The entire text and figures of all of the applications listed above and Canadian Application No. 2,433,202, filed Jun. 25, 2003, are hereby incorporated by this reference to them as if they were each fully set forth herein.

FIELD OF THE INVENTION

This invention relates to golf putters.

BACKGROUND OF THE INVENTION

A typical putter has an elongated head mounted on a shaft. One side of the head provides a face, generally parallel with the long axis of the head, for hitting the ball. With the bottom of the putter head lying flat on a level surface, the face may be vertical or tilted back a slight angle, called the loft of the putter, often between about 2 and 4 degrees. The shaft is attached to the putter head and extends from the head in a plane that is generally parallel to the long axis of the head and the face of the putter. With the bottom of the putter head again lying flat on a level surface, the shaft is angled upwards from the horizontal at an angle, called the lie of the putter, of between about 68 and 78 degrees. Some variations from this typical configuration will be discussed below.

U.S. Pat. No. 4,881,737 describes a putter with a cylindrical head. The side of the cylinder is used to contact the ball so the face is convex rather than flat. The shaft may be inclined between 16 degrees and 22 degrees relative to a vertical plane normal to the longitudinal centerline of the head. The inclination of the shaft may be varied because the end of the shaft is fitted with a partial cylinder, mounted with its central axis perpendicular to the shaft, that can rotate through the angles of inclination mentioned above in a slot in the head. A desired angle of inclination is fixed by screwing a wedge block into the slot to clamp the end of the shaft into the slot.

U.S. Pat. No. 5,348,295 describes a putter with an elongated head having a flat face. The end of the shaft has a sphere that is mounted in one of two pockets in the head. Each pocket prevents the sphere from leaving the head but permits the shaft to rotate through a range of lie angles. One pocket allows the shaft to be positioned relative to the face as appropriate for left handed golfers, while the other pocket allows the shaft to be positioned for right handed golfers. With the sphere in either pocket, set screws through the head are tightened against the sphere to hold the shaft at a desired lie.

U.S. Pat. No. 5,390,920 describes a putter with a head having a flat face at one side and bullet shaped weights protruding from the other side. A sphere on the end of the shaft is mounted in a cylindrical bore through the head. An annular shoulder in the bore prevents the sphere from coming out of the bore through the top of the head. A screw threaded into the bore from the bottom of the head locks the sphere in place between the annular shoulder and the top of the screw. The screw has a lower portion that breaks off as the screw is tightened in place to permanently fix the shaft at a desired lie and loft angle. The annular shoulder may be sharpened to provide a biting engagement with the sphere.

U.S. Pat. No. 5,692,969 describes a putter with a cylindrical head and convex face. The end of the shaft has a ball or cylinder that fits into a bore in the head. The top of the bore has a shoulder to engage the ball but also opens to the top of the head through an elongated opening. The elongated opening allows the shaft to pivot through lie angles of between 30 and 90 degrees while preventing the shaft from pivoting about the longitudinal axis of the head. A resilient plastic or aluminum retainer is inserted into the bore from the bottom of the head and held against the ball by a locking member threaded into the bore. A golfer alters the angle of the shaft relative to the head by applying weight to the resilient retainer to disengage the ball from the shoulder of the bore. An alternate embodiment has an offset shaft. Another alternate embodiment has a head with a flat face.

SUMMARY OF THE INVENTION

It is an object of the invention to improve on the prior art. Another object of the invention is to provide a putter. Another object is to provide a putter with a shaft that may be held in various positions relative to the head for putting but that requires no tools for the golfer to move the shaft to a new position. Another object of the invention is to provide a putter with a shaft that may alternately be locked in position so that it is essentially unmovable relative to the head or unlocked. Yet another object of the invention is to provide a putter suitable for putting from either the face or end of the putter. These and other objects of the invention are met by the combination of features, steps or both described in the claims. The following summary may not describe all necessary features of the invention which may reside in a sub-combination of the following features or in a combination of some or all of the following features and features described in other parts of this document.

In some aspects, the invention provides a putter with an elongated head. The head has a face for striking a ball along a long side of the head and at least one, but optionally two, end surfaces for striking a ball along a short side of the head. A shaft is connected to the head through a pivotable, and optionally rotatable, connection. The connection allows the shaft to be positioned (a) to be suitable for striking a ball with the face, or (b) to be suitable for striking a ball with the end surface. In some embodiments, the shaft may be positioned for striking a ball from the face or end surface for either left or right-handed golfers. The end surface or surfaces may have a loft of less than 5 degrees or a loft typical of putters or may have a loft of 5 degrees or more or a loft typical of chippers. In embodiments with two end surfaces, the end surfaces may have different lofts. The shaft may be held in each position such that it does not move appreciably while putting, but can be moved to another position by a golfer using their muscles alone, or without the assistance of tools. In each position, some embodiments allow the lie to be selected by the golfer and some embodiments provide abutments or detents to allow the golfer to consistently return to one or more shaft positions or to limit the range of shaft positions. In practice, the inventor has found that the face of the club is useful for putting from the manicured part of the green, while the end surfaces are useful for putting from the rougher parts of a green or from beyond the edge of the green or chipping. An end surface with an appropriate loft may also be suitable for putting from the manicured part of the green.

In other aspects, the invention provides a putter with a shaft that is pivotably mounted in the head, but all contact between the shaft and the head is made through one or more resilient, non-metallic materials such as rubber. In some embodiments, the shaft may pivot about two orthogonal axes and may also rotate, for example about a vertical axis.

In other aspects, the invention provides a putter with a head having a cavity in the head. A ball or sphere on the end of the shaft fits inside of the cavity. An annular nut or ring is placed in the top of the cavity and contains the ball in the cavity. The shaft exits through an opening in the center of the ring or through an opening in the other side of the cavity. The opening may also be defined by a plate constructing a larger opening in the ring or cavity. An O-ring, which may be rubber or other material, may be mounted in the cavity between the ball and the ring. The ring puts sufficient pressure on the O-ring to hold the ball so that the head does not move appreciably during a putt, but a golfer can still move the shaft using the golfer's muscles alone or without tools. The opening for the shaft may be sized and configured so that the shaft abuts the ring when the shaft is set at a useful lie. The putter may also be provided with a plurality of retainer rings that the golfer may chose from to select between different lies. The bottom of the ball on the shaft may also sit in an O-ring on the bottom of the cavity so that the ball does not contact any components fixed to the head other than through an O-ring. The bottom of the ball may also or instead rest on a screw threaded upwards into the cavity from the bottom of the head. The ball and screw may be shaped to fix the shaft at a useful lie but permit the shaft to rotate around a generally vertical axis through the ball. For example, a horizontal flat surface on the top of the screw may contact a flat spot on the ball, the flat spot being horizontal when the shaft is at the useful lie. Regardless of whether there is a flat spot on the ball, the screw can be turned into the head far enough to effectively lock the shaft in a single position for a round of play. With a flat spot on the ball, the screw may be turned out slightly to effectively fix the lie of the shaft but allow the shaft to rotate about a vertical axis or turned out further to provide a detent at a useful lie but not prevent the golfer from moving the shaft to a different lie. The screw may also be turned out yet further to not contact the ball in which case the ball may either rest on a lower O-ring or directly on the bottom of the cavity.

In other aspects, the invention provides a putter with a head and a shaft whereby the shaft can alternately be made more or less moveable or fixed relative to the head by manipulating, for example twisting, the shaft. The shaft may be connected to one or more solids, for example a split ball, that lie within a cavity in the head. The cavity, shaft and solid or solids are shaped and arranged to provide at least three potential points of contact between the cavity wall and (i) the solid or solids alone, or (ii) the solid or solids and the shaft together. The connection between the cavity wall and solid or solids or possibly the shaft allows a golfer to change the position of at least one potential point of contact relative to the other potential points of contact. This change can be made, for example, by manipulating the shaft. Changing the position of at least one potential point of contact causes the solid or solids or shaft to bind more or less forcefully, or not at all, with the cavity wall. This allows the golfer to make the shaft more or less moveable relative to the head. In some embodiments, movement of the shaft is restricted to rotation at a single lie angle or to pivoting within a limited range of lie angles. In some embodiments contact between the potential points of contact and the cavity wall may be made through pads made of a resilient, compressible material, for example, rubber or plastic.

In other aspects, the invention provides a putter that allows a golfer to change the loft of the face or end surface of the head even though the shaft may not be moveable relative to the head. A wedge is affixed to the face or end surface of the head. The wedge may be sized and configured to achieve a desired loft when the wedge is affixed to the face or end of the putter. The putter may be provided with a plurality of wedges so that a golfer may select a desired loft angle. In some embodiments the wedge may be attached in two or more orientations, for example, (a) with a thin end of the wedge toward the top of the head achieve one loft angle, or (b) with a thick end of the wedge toward the top of the head to achieve a different loft angle. When the wedge may be attached in two or more orientations, a number of loft angles may be achieved with fewer wedges.

In other aspects, the invention provides one or more ball scoops in a side of the head opposite the face to allow the golfer to pick up golf balls from the ground, a widened end surface to provide a larger surface area for putting off the end of the putter, and raised sight lines on the top of the head to allow a golfer to sight a putt when putting off the face or an end of the putter or an extendable shaft.

In other aspects, the invention provides a putter with a shaft that may be moved within a range that complies with the rules of golf. The shaft may be fixed in the desired position for a round of play. One or two faces may be provided in accordance with the rules of golf, for example, the rules of The United States Golf Association, The Royal and Ancient Golf Club of Saint Andrews or The Royal Canadian Golf Association.

BRIEF DESCRIPTION OF THE DRAWINGS

For a better understanding of the invention, and to show more clearly how it may be made and used, various examples of embodiments of the invention will be described below with reference to the following drawings.

DETAILED DESCRIPTION OF THE INVENTION

General Description of the Putter

Figure 1:
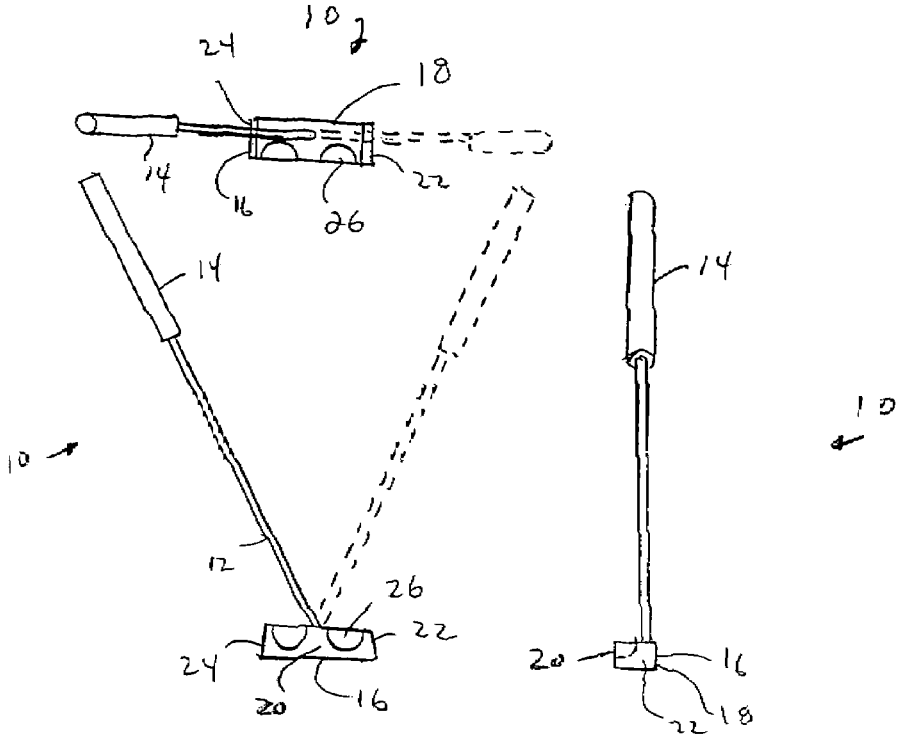
FIGS. 1 and 2 are schematic representations of a putter according to one or more embodiments of the invention configured for putting against the face and end of the putter head respectively.
Figure 2:
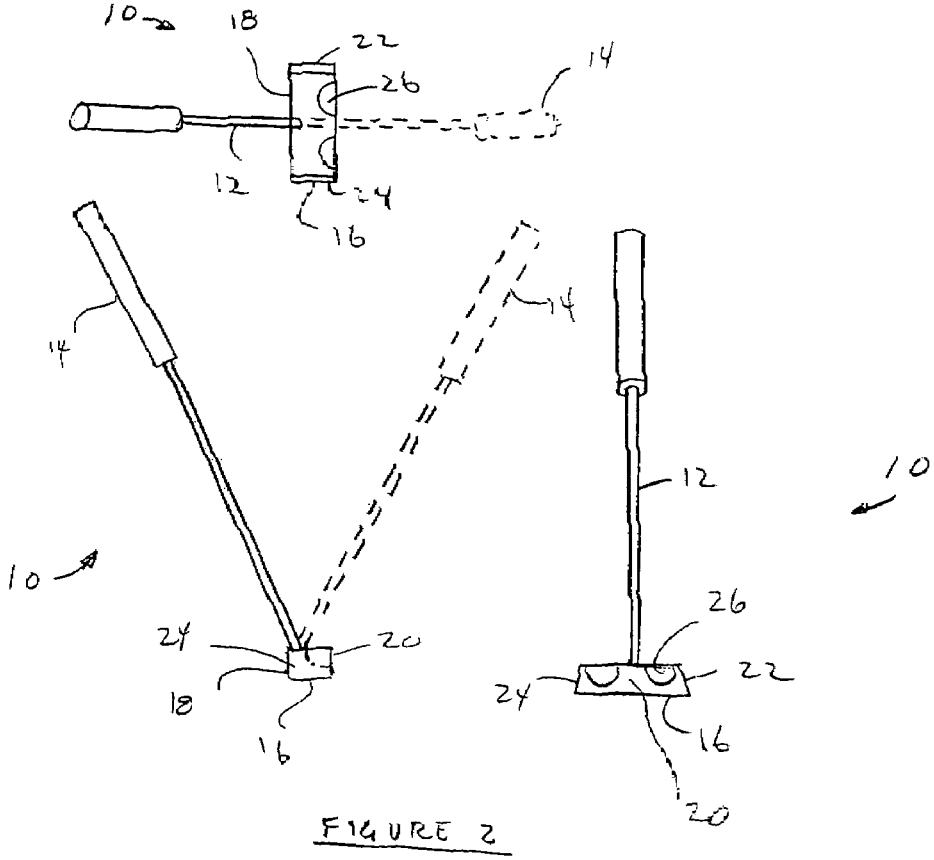

FIGS. 1 and 2 show a putter 10 according to one or more embodiments of the invention. The putter 10 has a shaft 12 with a handle 14. The handle 14 may be round or may have a flat spot or other feature of shape to allow a golfer to better hold the putter in a desired orientation. The shaft 12 is attached to a head 16 that has a face 18, a side 20, a first end 22 and a second end 24. The face 18 provides a surface for striking a golf ball along the side of the head 16. The face 18 may have a slight loft, for example of a few degrees, to make it suitable for play on a smooth green. The side 20 may provide a second surface for striking a golf ball, may have an irregular surface, or may include one or more ball scoops 26 as shown. The ball scoops 26 allow a golfer to pick up a ball from the ground. The first end 22 and second end 24 may have an irregular surface or may be made flat to provide additional surfaces for striking a golf ball. If the ends 22, 24 provide striking surfaces, they may be given a slight loft as for the face 18, or they may be given a larger loft, for example between about 5 and 25 degrees. Each end 22, 24 may also be given a different loft. For example, the first end 22 may have a loft between about 15 and 25 degrees, while the second end 24 may have a loft of between about 5 and 15 degrees. The head 16 may be made of brass, aluminum, manganese bronze, zinc, stainless steel, plastic or other materials suitable for putters. The total weight of the head 16 may vary, for example between about 9 and 16 ounces. The head 16 may be made or shaped by machining, casting, forging, pressed powdered metal or other suitable methods. The shaft 12 may be conventional and may be between about 33 and 36 inches in length. Alternately, the shaft 12 may be adjustable in length. Adjustable shafts are described, for example, in U.S. Pat. Nos. 1,982,089; 3,102,726; and, 5,569,096 all of which are incorporated herein in their entirety by this reference to them.

The shaft 12 may be pivoted to change its angle in relation to the head 16 according to various means that will be described below. For example, FIGS. 1 and 2 show the putter 10 configured into some of its possible configurations. In FIG. 1, the putter 10 is configured for putting with the face 18. The position of the shaft 12 shown in solid lines is appropriate for right handed golfers while the position shown in dashed lines is appropriate for left handed golfers. Although a single lie of the shaft 12 and loft of the face 18 are shown, in some embodiments, the golfer may set the lie of the shaft 12 at any desired angle and may also be able to rotate the head 16 relative to a vertical plane through the shaft to simulate a change in the loft of the face 18 or simply allow for holding the shaft 12 at an angle to the face 18 perpendicular to the angle of the lie. In FIG. 2, the putter 10 is configured for putting from one of the ends 22, 24. A vertical plane through the shaft 12 is generally perpendicular to the face 18 and the shaft 12 has a lie angle within that plane. The position of the shaft 12 shown in solid lines is appropriate for right handed golfers to putt using the first end 22 or for left handed golfers to putt using the second end 24. The position of the shaft 12 shown in dashed lines is appropriate for left handed golfers to putt using the first end 22 or for right handed golfers to putt using the second end 24. Although a single lie of the shaft 12 and loft of the face 18 are shown, in some embodiments, the golfer may set the lie of the shaft 12 at any desired angle and may also be able to rotate the head 16 relative to a vertical plane through the shaft 12 to simulate a change in the loft of the face 18 or allow angling the shaft 12 relative to the face 18 in a direction perpendicular to the angle of the lie. The inventor has found that, when putting from rougher grass around the edge of a green, striking the ball with an end 22, 24 allows the head 16 to swing more easily through the grass and that the larger loft of the ends 22, 24 assists in moving the ball through the grass. For example, in situations where a golfer with ordinary clubs must decide between using a putter or a wedge, configuring the putter as shown in FIG. 2 and striking the ball with one of the ends 22, 24 is often ideal.

This general description is intended to introduce the reader to possible configurations of a putter. Some of the embodiments are not capable of all of these configurations and it is not a requirement of the invention that a putter be capable of all of these configurations. Further, some embodiments are configured to prohibit some of these configurations. For example, some putters permit only configurations that comply with the rules of golf. Other embodiments permit only a subset of the possible configurations to allow a golfer to experiment with only a subset of the possible configurations at one time.

Description of a First Embodiment

Figure 5:
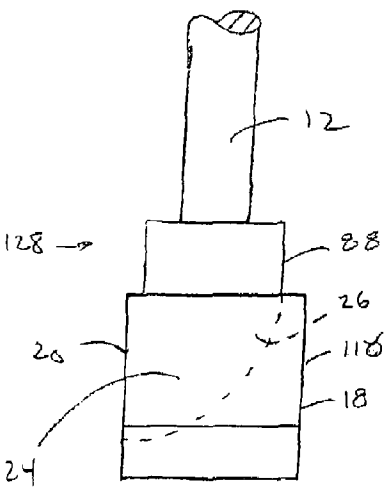
FIGS. 3, 4 and 5 are side, top and end views of the head and portions of the shaft and connection between the head and shaft of a first embodiment.
Figure 4:
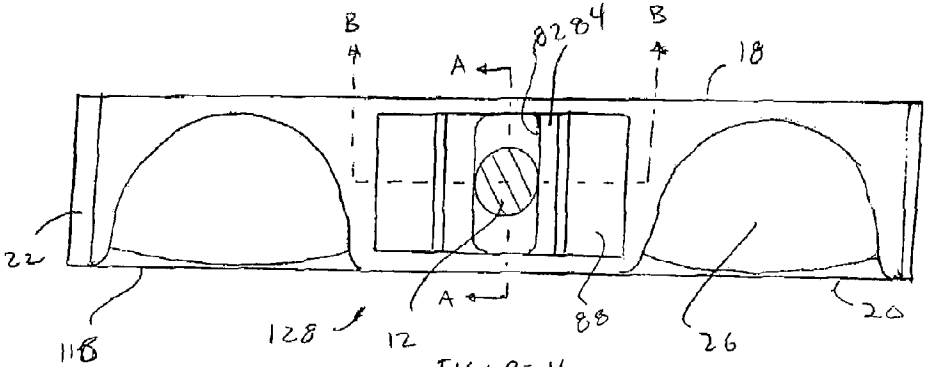
Figure 3:
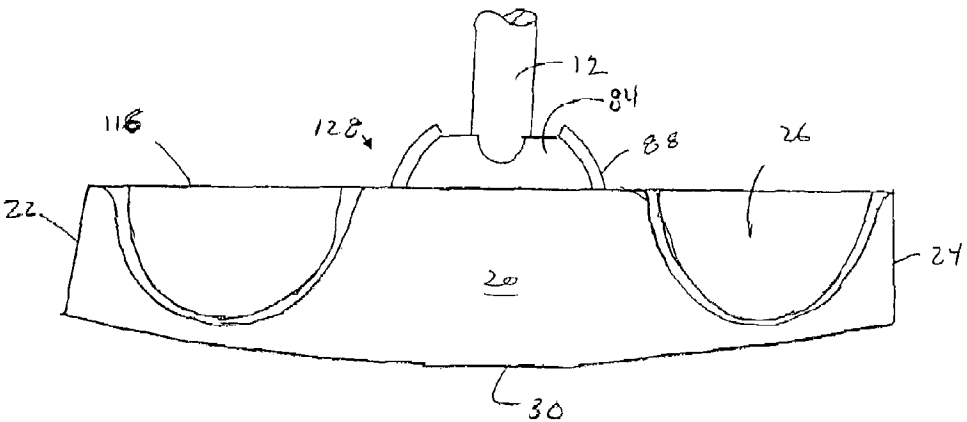

FIGS. 3, 4 and 5 show a first head 116 connected to a shaft 12 through a first connection 128. The first head 116 has a face 18, first end 22, second end 24 and ball scoops 26 as described above. The first head 116 is about 5.5 to 5.75 inches long, about 1 to 1.25 inches wide and about 1 inch high although other suitable dimensions may also be used. The length of the first head 116 helps distribute the weight away from the center of the first head 116, which increases the size of the "sweet spot" while also providing room for two ball scoops 26. The ball scoops 26 are roughly in the shape of a quarter of a sphere of a radius slightly larger than a golf ball, for example between about 0.86 and 0.88 inches. The ball scoops 26 may be given a radius where they intersect with the side 20 of the second head 116 to allow a golf ball to roll into them more easily. The shape of the ball scoops 26 may also deviate from a perfect sphere to better hold a golf ball or to adjust the weight or balance of the head. A portion of the bottom surface of the second head 116 may provide a flat sole 30. However, the remainder of the bottom surface may curve or angle upwards towards the ends 22, 24, for example by about 0.25 inches, to provide additional swing clearance when putting from the ends 22, 24.

Figure 8:
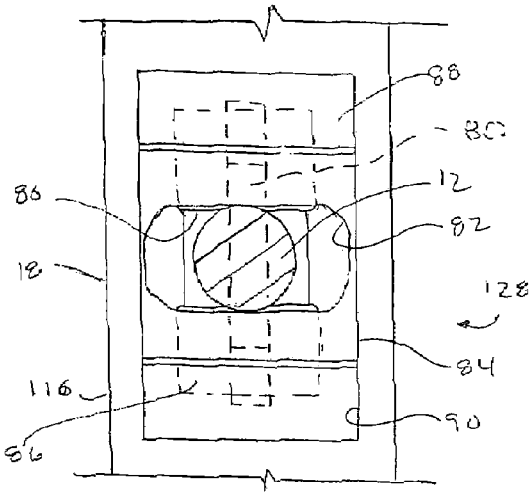
FIGS. 6, 7 and 8 are side section, end section and top views detailing the connection between the head and shaft of the first embodiment.
Figure 7:
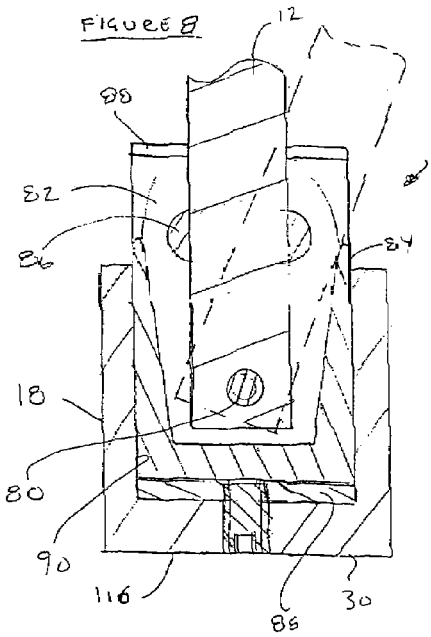
Figure 6:
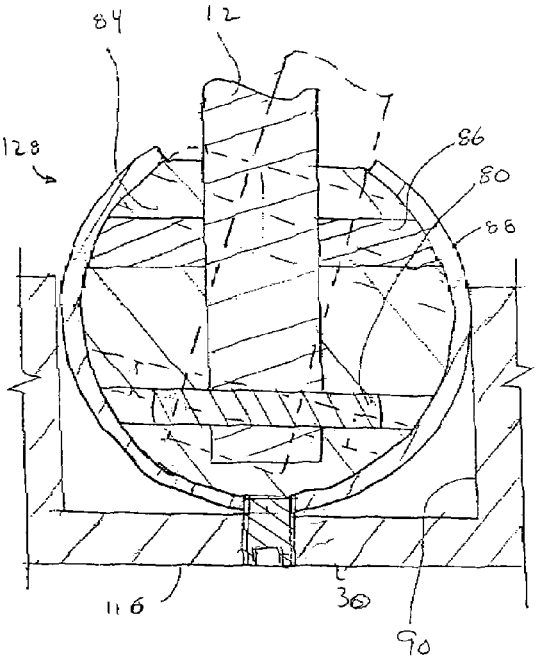

FIGS. 6, 7 and 8 show the first connection 128 in greater detail. The shaft 12 is pinned by a pin 80 into a slot 82 in a disc 84. The slot 82 provides clearance for the shaft to rotate about the pin 80, for example, to the side as shown in dashed lines in FIG. 7. The shaft 12 can also rotate to the other side and through any angle in between. The shaft 12 is held at any angle by friction provided by rubber pads 86. The pads 86 hold the shaft 12 with enough force to prevent the first head 116 from moving appreciably during a putt, but a golfer may still move the shaft 12 with muscle force alone and without tools. The pads 86 may also be made of other suitable materials that can provide a similar amount of friction.

The disc 84 is mounted in an outer ring 88 held in an opening 90 of the first head 116 by a setscrew 92 that may be sized to not protrude from the sole 30. The disc 84 can rotate in the outer ring 88 but the pads 86 provide friction between the disc 84 and the outer ring 88 as described above. The ring 88 may be made from a tube with an inside diameter slightly smaller than the outside diameter of the disc 84. Once cut and bent over the disc 84, the ring 88 then creates some friction with the disc 84. The shaft 12 can be rotated towards one end 22, 24 of the first head 116 as shown in dotted lines in FIG. 6. The shaft 12 can also be rotated towards the other end 22, 24 or positioned at any angle in between. Again, the pads 86 hold the shaft 12 with sufficient force for putting, but a golfer can still move the shaft 12 using their muscles alone without tools.

Optionally, one edge of the outer ring 88 can be extended to prevent the shaft 12 from being moved into a lie of greater than 80 degrees and the width or shape of the disc 84 can be made so that the shaft can not be angled more than 20 degrees from the horizontal, in a plane perpendicular to the angle of the lie, to correspond with the rules of golf. Ends 22, 24 may also need to be made non-suitable for striking a ball and means to fix the shaft 12 for a round of play added to make this embodiment comply with the rules of golf. Means to fix the shaft 12 may, for example, involve a set screw through the sole 30 to releasably contact the outer ring 88 and a pair of opposed set screws through the flat sides of the disc 84 to contact opposed sides of the shaft 12.

Description of a Second Embodiment

Figure 10:
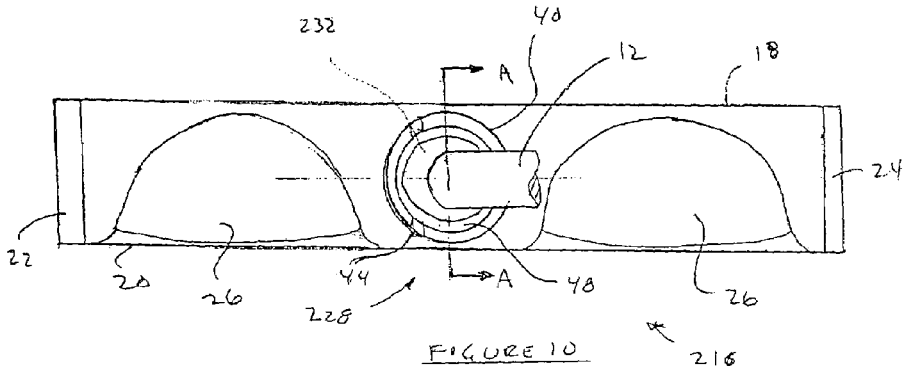
FIGS. 10 and 11 are top and perspective views of the head, shaft and connection between the head and shaft of the second embodiment.
Figure 11:
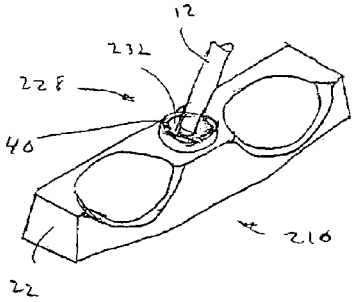
Figure 9:
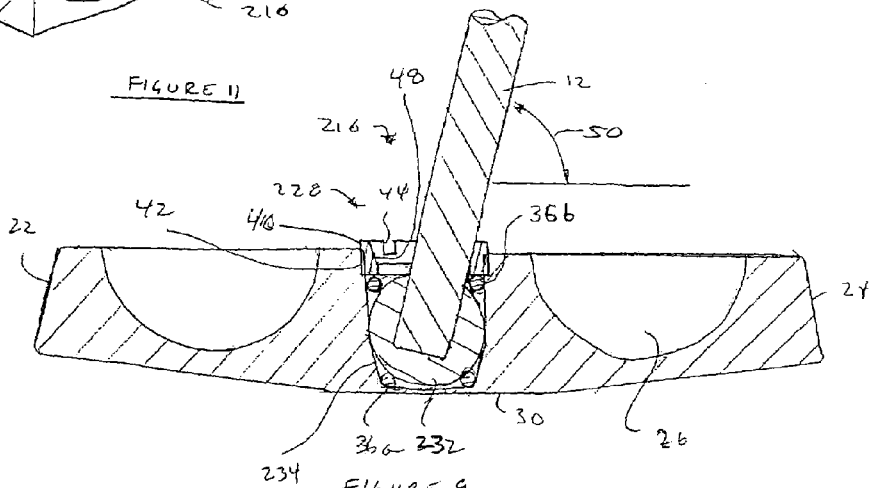
FIG. 9 is a sectioned side view of the head, shaft and connection between the head and shaft of a second embodiment, sectioned through the center of the shaft.
Figure 14:
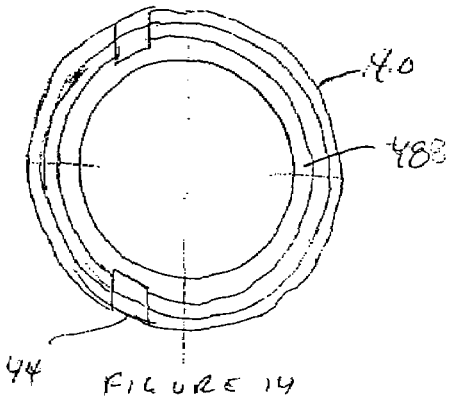
FIGS. 14, 15A and 15B are top views of a retaining ring and gates of the second embodiment.
Figure 13:
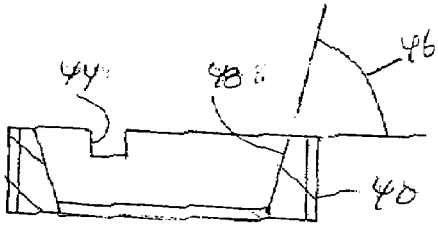
FIGS. 12 and 13 are section views of a cavity and a retaining ring of the second embodiment, sectioned along the line A-A in FIG. 10.

FIGS. 9, 10 and 11 show a second head 216 connected to a shaft 12 through a second connection 228. The second head 216 is shaped generally as described in the first paragraph of the description of the first embodiment except as required for the second connection 228.

The second connection 228 is shown in FIGS. 9 to 14. A sphere or ball 232 is attached to the end of the shaft 12. The ball 232 may be made of metal and attached to the shaft 12, for example, by gluing, pinning or threading the ball 232 to the shaft 12. The ball 232 fits inside of a cavity 234 in the second head 216. There is at least a slight clearance all around the ball 232 so that, while the cavity 234 may prevent the ball 232 from moving laterally out of position, the ball 232 is free to rotate within the cavity 234. The ball 232 is also positioned by, and seated in, a pair of rubber O-rings 36. A lower O-ring 36*a* rests on the bottom of the cavity 234 and holds the bottom of the ball 232 clear of the bottom of the cavity 234. Lower O-ring 36*a* may have an outside diameter smaller than the diameter of the ball 232 to allow the bottom of the cavity 234 to be nearly flat. A lower portion 38 of the cavity 234 is tapered to provide a reduced diameter for lower O-ring 36*a*. An upper O-ring 36*b* sits on top of the ball 232. The outside diameter of upper O-ring 36*b* may be about the same as the diameter of the ball. The outside diameter of the upper O-ring 36*b* may also be slightly larger than the diameter of the ball 232, particularly, if the second head 216 is cast and the cavity 234 has a slight drift angle opening towards the top of the second head 216.

The ball 232 is held in the cavity 234 by a retaining ring 40 that is threaded into a threaded portion 42 at the top of the cavity 234. The retaining ring 40 can be turned with any thin item, such as has a knife blade, inserted into a pair of tightening slots 44 in the edges of the retaining ring 40. The retaining ring 40 can be rotated to adjust how much the O-rings 36 are compressed which in turn adjusts the amount of friction between the shaft 12 and the second head 216. For example, the retaining ring 40 can be set so that there is sufficient friction to prevent the shaft 12 from moving relative to the second head 216 during a putt while still allowing a golfer to easily move the shaft 12 relative to the second head 216 by muscle force alone. Since the O-rings 36 are compressible and flexible, yet develop significant amounts of friction with even small amounts of pressure, the exact position of the retaining ring 40 is not overly critical and an acceptable degree of compression is easily found by trial and error. If the golfer wishes to lock the shaft 12 in one position, for example if rules prevent moving the shaft 12 during a round, the retaining ring 40 can be tightened down further so that the shaft 12 will not move under any reasonable force. If desired, one or more locking screws (not shown), which may have sharp points and may be orthogonal to each other, may be threaded through the second head 116 to put additional pressure against the ball 232 to even more securely fix the shaft 12 in a position. Optionally, rules compliance may be achieved by replacing the slots 44 with a different feature that requires a tool to move the retaining ring 40 and does not allow adjustments to be readily made. For example, the retaining ring 40 can have serrated outer edges and be tightened down with pliers.

The shaft 12 exits the cavity 234 through the retainer ring 40 and so the inner surface 48 of the retainer ring 40 controls the minimum lie 50 of the shaft 12. To provide a broader area of contact with the shaft 12, all or part of the inner surface 48 may be made at a retainer angle 46 which matches the minimum lie 50. Retainer rings 40 providing a variety of minimum lies 50 are useful, and a plurality of retainer rings 40 may be provided with the second head 216 to allow the golfer to use different retainer rings 40 as desired. For example, most golfers prefer a lie that allows them to stand with their eyes directly above the ball when standing on level ground. However, when standing on uneven ground, a different lie may be required to allow the golfer to stand with their eyes directly over the ball. A retainer ring 40 that provides a minimum lie 50 lower than what the golfer would use on level ground allows the golfer to adjust the lie as required for uneven ground. On the other hand, a golfer may choose to putt with the same lie all situations in the hopes that consistency will improve his or her game. A retainer ring 40 that provides a minimum lie 50 that is that same as the lie that a golfer might use for all situations allows the golfer to always set the shaft 12 at the same lie, even when switching back and forth between putting against the face 18 as shown in FIG. 1 and putting against an end 22, 24 as shown in FIG. 2. Further, a golfer may wish to experiment with different defined lies without buying several putters. By using different retainer rings 40 and always playing with the shaft 12 abutting the retainer ring 40, a golfer can perform repeatable experiments to determine a preferred lie.

Figure 15B:
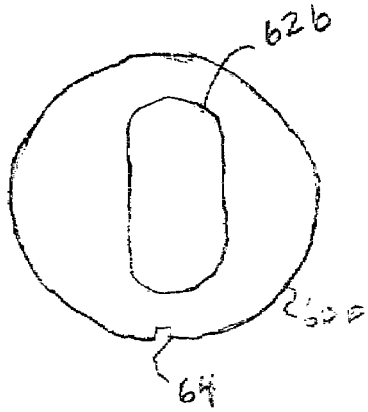
Figure 12:
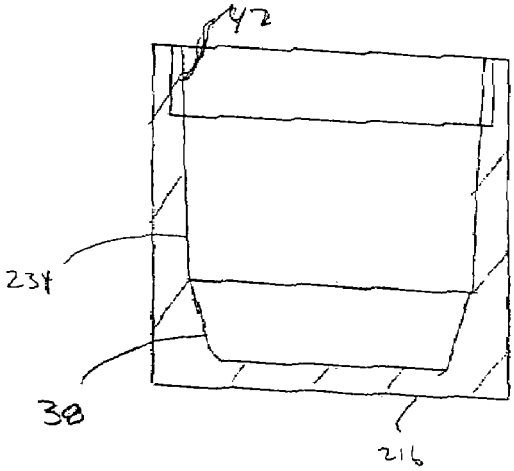
Figure 15A:
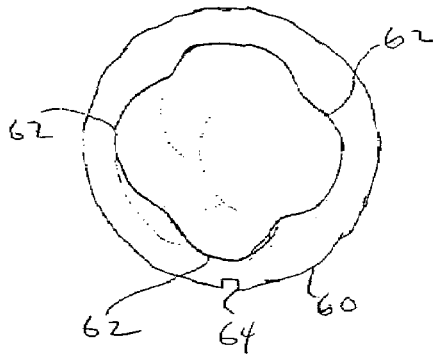

Although this second embodiment allows a plane through the shaft 12 to be located at any angle from the face 18, and allows the face 18 and ends 22, 24 to be angled from the vertical to simulate a variety of lofts, some golfers may wish to use only the positions shown in FIGS. 1 and 2. To make it easier to set the shaft 12 in those positions, a gate 60, as shown in FIG. 15A, may be inserted between the upper O-ring 36*b* and the retainer ring 40. The gate 60 is made of a thin plate material with an outside diameter that allows it to fit into the cavity 234. The inside of the gate 60 is cut to provide detents 62 of about the same radius as the shaft 12. A locating notch 64 in the gate 60 mates with an abutment (not shown) in the cavity 234 to index the detents 62 to the face 18 or ends 22, 24. By pulling the shaft 12 into the detents 62, the shaft 12 can be easily set into the positions shown in FIGS. 1 and 2. Alternately, FIG. 15B shows a second gate 606 with a slot shaped second detent 626 that allows the shaft 12 to only be positioned at angles that comply with the rules of golf. Ends 22, 24 may also need to be made unsuitable for striking a ball to make this embodiment fully comply with the rules, if that is desired.

A Third Embodiment

Figure 16:
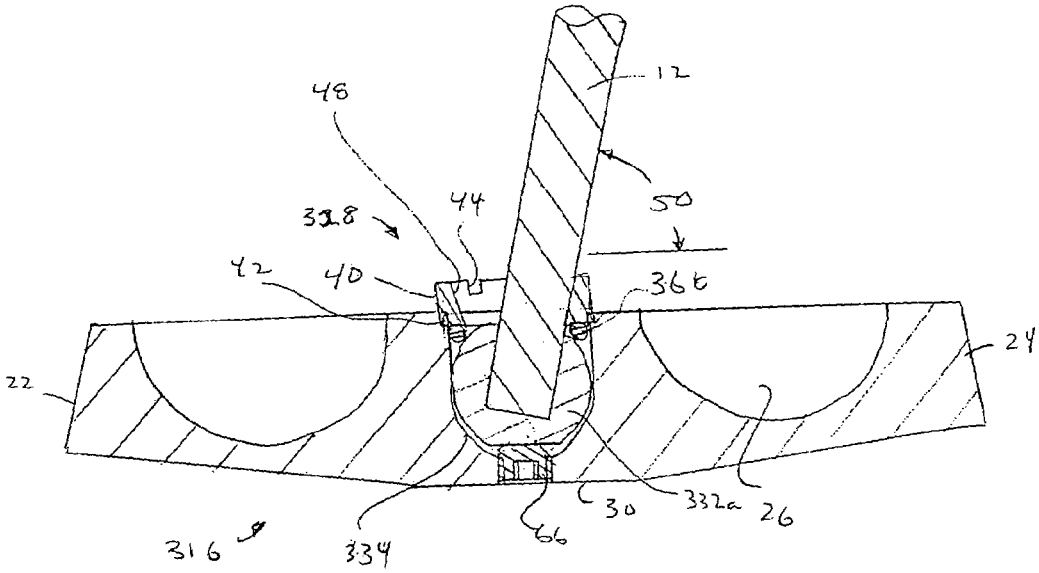
FIG. 16 is a sectioned side view of the head, shaft and connection between the head and shaft of a third embodiment.

FIG. 16 shows a third head 316 connected to a shaft 12 through a third connection 328. The third head 316 is shaped generally as described in the description of the first embodiment except for the differences described below.

Figure 17:
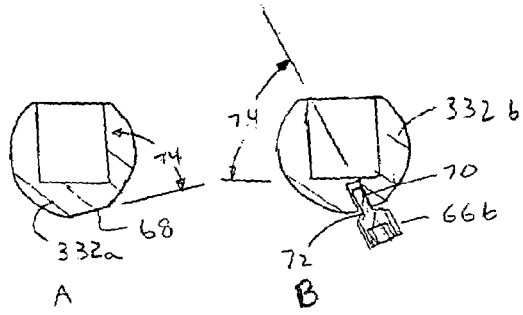
FIG. 17 is sectioned side views of two balls of the third embodiment.

Referring to FIGS. 16 and 17, a third ball 332 is attached to the end of the shaft 12. The third ball 332 fits inside of a third cavity 334 in the third head 316. The third cavity 334 may prevent the third ball 332 from moving laterally out of position, but does not prevent the third ball 332 from rotating. The third ball 332 is also positioned by and seated in an upper O-ring 36*b*, which may be made of rubber, nylon or other materials depending on the degree of friction desired. In place of, or in addition to, the lower O-ring 36*a* of the second embodiment, a screw 66 protrudes into the third cavity 334 and contacts the bottom of the third ball 332. The screw 66 is threaded into the bottom of the third head 316 and may engage a tool, such as a screwdriver head or Allen key, while not protruding below the sole 30. The third cavity 334 has a shape similar to that described in the second embodiment except that it is displaced away from the sole 30 to leave enough material at the bottom of the third head 316 to thread the screw 66. The screw 66 may be turned in to hold the bottom of the ball 232 clear of the bottom of the third cavity 334. The screw 66 may contact the third ball 332 directly, or through a rubber washer (not shown) to increase the friction between the screw 66 and the third ball 332. The third ball 332 is shaped to inhibit or prevent it from rotating about any axis other than the central axis of the screw 66 when a certain part of the third ball 332 contacts the screw 66. For example, third ball 332*a* has a flat 68 that abuts the top of the screw 66. Third ball 332*b* has a screw hole 70 that admits the screw 66 or a screw pin 72 at the top of a modified screw 66*b*.

The flat 68 or screw hole 70 are oriented to provide a lie 74. A set of third balls 332 may be provided to the golfer to allow the golfer to experiment with different lies 74. Since the retaining ring 40 is no longer solely responsible for maintaining the shaft at a desired angle, the retaining ring 40 may have a minimum lie 50 that is less than the lie 74. Alternately, the retaining ring 40 may have a minimum lie 40 that is approximately equal to the lie 74 to take stress away from the third ball 332. As a further option, the retaining ring 240 may be omitted and replaced with a circular or gated opening through the top of the third head 316 which has enough diameter to permit a desired lie 74. In this case, the third cavity 334 is modified to allow the third ball 332 to be inserted through the sole 30 and the screw 66 is made larger in diameter to thread into the modified third cavity 334.

Adjusting the position of the set screw 66 and/or the retainer ring 40 affects how much the upper O-ring 36*b* is compressed and allows the golfer to produce enough friction to keep the third head 316 stable for a putt but still allow the golfer to move it. It is also possible to tighten the screw 66 and/or retaining ring 40 further so that a golfer cannot move the third head 316 relative to the shaft 12 by muscle alone. Although only the lie 74 is mechanically fixed, the shaft 12 can be effectively locked in a single position as may be required to play a round under some rules. A gate 60 as described for the second embodiment may be used and makes this locking in place even more secure. Optionally, the screw 66 and/or retainer ring 40 can also be adjusted to allow the shaft 12 to rotate into the positions shown in FIGS. 1 and 2, but at a single lie in all positions. As a further option, the screw 66 and the retainer ring 40, when used at least with third ball 332*a*, may also be loosened to the point where only a detent is provided. The shaft 12 falls naturally into an angle equal to the lie 74 but the shaft 12 can also be forced to assume other angles when desired. As a further option, the screw 66 can be turned out so that it does not contact the third ball 332 at all. Among other things, a golfer can make repeated puts with the ball 332 held firmly but movably and then tighten the screw 66 further only after a desired shaft 12 position is located.

Many other variations are possible. For example, and without limitation, the ball 332 may be replaced with a cylinder and the O-rings 36 replaced with flat annular washers with some alteration to the embodiments described above. The O-rings 36 may also be replaced with similar items made of different materials to alter the friction characteristics. For example, other compressible, elastic materials, such as silicone, may provide similar but slightly more or less friction and different wear characteristics. Metals or plastics may significantly reduce the friction so that only the various detents, or new detents in addition to those described above, provide usable positions of the shaft 12. Replacing the O-ring with a serrated metal part could significantly increase the friction to allow a single position of the shaft to be very securely fixed. Parts to replace the O-rings made of several materials may be provided with a putter to allow a golfer to create different levels of friction as desired. Various splines, pins, screws, keyways etc. may be added to various locations to provide detents or fixed positions. Another option is to use a ball that is round at the bottom, for example the ball 232 of the second embodiment, optionally with the gate 606 of FIG. 15B. Despite the round bottom of the second ball 232, with a suitable choice of O-ring 366, the screw 66 may be capable of locking the shaft 12 in place securely enough to comply with the rules of golf. To aid in this, the O-ring may also be made of a different shape that provides more area of contact with the ball 232.

A Fourth Embodiment

Figures 18, 19:
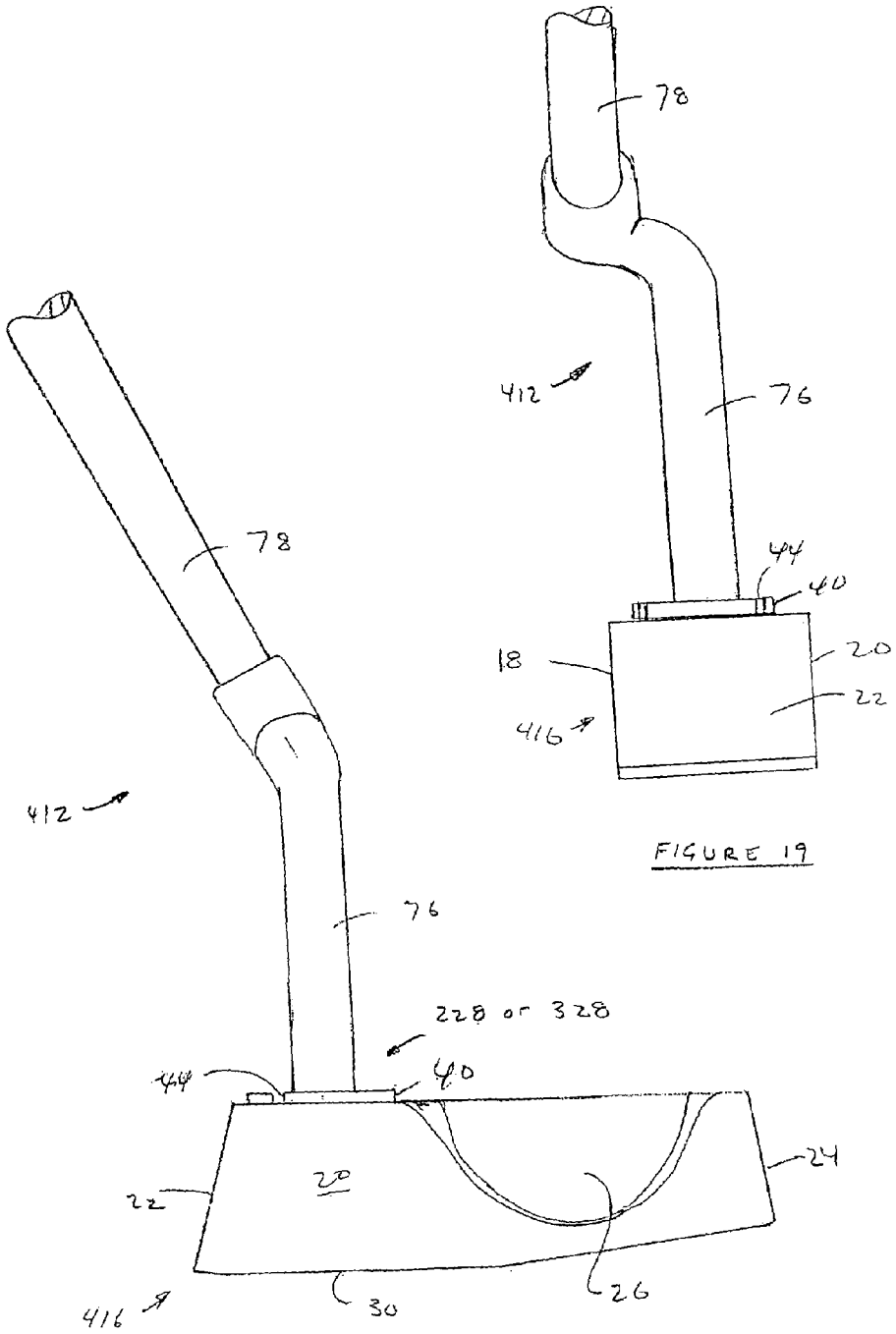
FIGS. 18 and 19 are side and end views of a fourth embodiment.

FIGS. 18 and 19 show a fourth embodiment having a fourth shaft 412 made of a lower portion 76 and an upper portion 78 and a fourth head 416. One of the portions 76, 78, such as the lower portion 76, provides an angle between the two portions 76, 78 as shown in FIG. 18. This angle may be selected to provide a desired lie with the lower portion 76 being generally vertical where it joins with the fourth head 416. Any of the connectors 128, 228, 328 discussed above may be used to join the fourth shaft 412 to the fourth head 416 although only the second or third connectors 228, 328 are shown. If a third connector 328 is used, the flat 68 or screw hole 70 may be located directly below the fourth shaft 412 and perpendicular or parallel to it. Without changing the third ball 332, different lies may be provided by using portions 76, 78 which provide for different angles between them, or the portions 76, 78 may be joined so that the angle between them can be varied. One of the portions 76, 78, such as the lower portion 76, may also provide an offset between the two portions 76, 78 as shown in FIG. 19.

The fourth head 416 is shown in FIGS. 18 and 19, but any of the previous heads 16, 116, 216, 316 may also be used. The fourth head 416 extends primarily in one direction from the connector 228, 328 and has only one ball scoop 26. Heads like the fourth head 416 may also be used in any of the previous embodiments. In this fourth embodiment, the combination of the fourth head 416 with the fourth shaft 412 keeps the fourth shaft 416 out of the golfer's line of sight to the "sweet spot" of the face 18 when putting against the face 18. The offset shown in FIG. 19 also puts a vertical plane through the upper portion 78 near the face 18 when putting against the face 18 and near the first end 22 when putting against the first end 22.

A Fifth Embodiment

Figure 20:
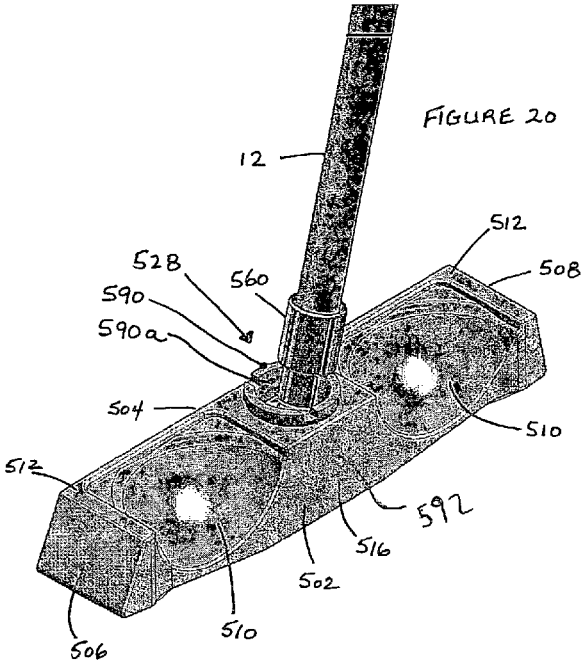
FIG. 20 is a perspective view of a fifth embodiment.
Figure 21:
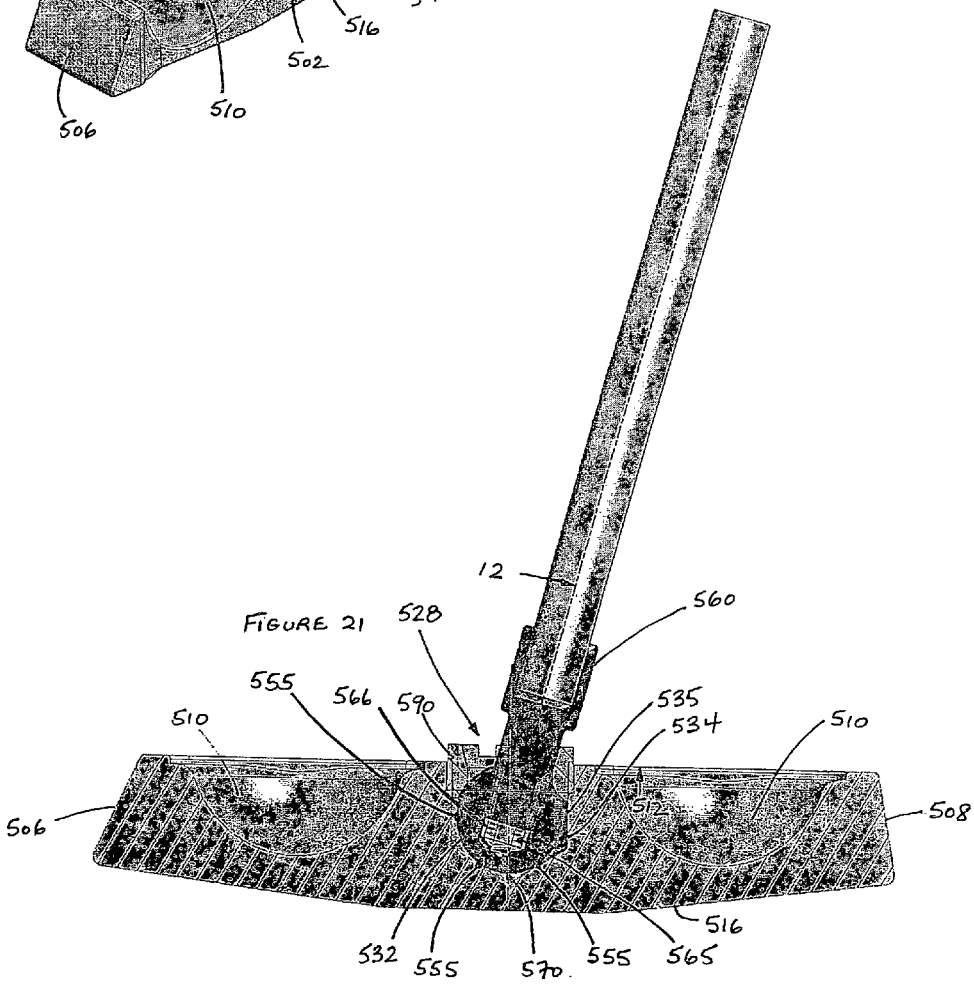
FIG. 21 is a sectioned side view of the head, shaft and connection between the head and shaft of a fifth embodiment, sectioned through the center of the shaft.

FIGS. 20 and 21 show a fifth head 516 and shaft 12 that are connected via a fifth connection 528. The fifth connection 528 allows the shaft 12 to alternately become more or less moveable relative to the head 516 by manipulating the shaft 12, for example, by twisting the shaft 12. By manipulating the shaft, a golfer may cause 4 or more potential points of contact to engage the cavity wall with more or less force, or to disengage one or more of the points of contact from the cavity wall. In this way, a golfer can select between at least two degrees of connection between the shaft and the head. The various degrees of connection may include two or more of: (i) head substantially unfixed, for example, it may move under its own weight, (ii) head remains in position when the putter is picked up but is not fixed enough to prevent movement during a putt, (iii) engagement with sufficient force to prevent movement during a putt, but the shaft can still be conveniently repositioned by hand without moving any points of contact relative to each other, or (iv) engagement with sufficient force to prevent movement during a putt, but the shaft cannot be conveniently repositioned by hand without moving any points of contact relative to each other. Selection between these various degrees of connection are also provided in some of the other embodiments. In those embodiments, however, engaging or disengaging a point of contact was achieved by altering the shape of a cavity. In this embodiment, a similar effect is achieved by leaving the cavity of a fixed size and shape and altering the size or shape of a component fixed to the shaft, or altering the size and shape of both the cavity and a component fixed to the shaft.

The fifth head 516 is shown in FIGS. 20 and 21. Any other suitable head, including any of the heads 16, 116, 216, 316, 416 previously described, may also be used provided they are modified as required for the fifth connection 528. The fifth head 516 has a body 502, a face 504, a first end 506 and a second end 508, and ball scoops 510. The first end 506 and second end 508 are wider than the body 502 to create a larger putting surface when a golfer putts from an end 506, 508. The fifth head may have a raised lip 512 around its upper perimeter. The raised lip 512 helps to guide a golfer's putt by providing sight lines that are available to sight both when putting from the face 504 or putting from an end 506, 508. A head like the fifth head 516 may also be used in any of the previous embodiments.

The fifth head 516 has a cavity 534 defined by a cavity wall 535. A solid 532, for example a partially split sphere, is inserted into and lies within the cavity 534. Optionally more than one solid may lie within the cavity as described further below. The shaft 12 may connect with the solid 532 via a hosel 560. The hosel 560 may be made of metal and fixedly attached to the shaft 12, for example, by gluing or pinning the hosel 560 to the shaft 12. Optionally the hosel 560 may be omitted, in which case the shaft 12 would be designed and configured to connect directly with the solid 532.

The cavity 534 may open toward the top of the fifth head 516, as shown in FIGS. 20 and 21, but optionally the cavity 534 may open toward the bottom or side of the fifth head 516. Where the cavity 534 opens toward the bottom or side of the fifth head 516, the fifth head 516 is provided with an opening at the top that is wide enough to allow the shaft 12 to enter the cavity 534 and to allow the shaft 12 to move through a desired range of positions or lie angles.

Figure 22:
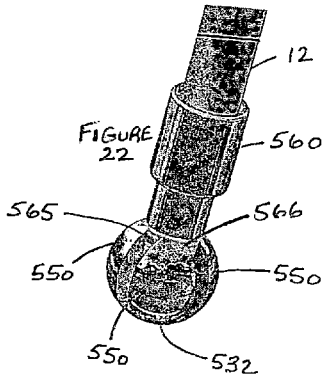
FIG. 22 is a side view of the shaft, hosel and solid of a fifth embodiment detailing the connection between the hosel and solid.

The cavity 534 and solid 532 are sized and shaped to permit at least three potential points of contact 555 between the cavity wall 534 and the solid 532. The connection between the shaft 12, optionally through the hosel 560, and the solid 532 allows a golfer to change the position of at least one potential point of contact 555 relative to other potential points of contact 555 by manipulating the shaft 12. As shown in FIGS. 20-22, the solid 532 may be generally spherical and the cavity 534 may be a cylindrical bore with a diameter slightly larger than an unextended diameter of the solid 532. The solid 532 may have a threaded bore 566 to connect with the hosel 560. The solid 532 may be partly split into two or more sections 550, the splits not extending completely through the solid 532. The splits may be made through one or more planes parallel to the central axis of the bore 566 and passing through the bore 566. The hosel 560 may have a tapered thread 565 that is tapered toward the bottom to connect with a tapered bore 566 of the solid 532. For example, both the hosel 560 and the bore 566 may be cut with NPT threads. Instead of a tapered thread 565 and bore 566, the hosel 560 may be designed, for example, with a straight thread and a tapered section above the treaded section. In either case, as the shaft 12 and hosel 560 are twisted in one direction (such as clockwise) the hosel 560 is drawn into the solid 532 by the threaded connection 565, 566. Wider sections of the hosel 560 are drawn into the solid, forcing the sections 550 of the solid 532 to spread apart. The hosel 560 may be moved deeper into the solid 532 until a desired increased degree of contact is achieved between points of contact 555 lying on the outer surface of the solid 532 and the cavity wall 535. Twisting the shaft 12 in the opposite direction (such as counterclockwise) draws the hosel 560 out of the solid 532. The solid 532 is sufficiently resilient to allow the sections 550 to recoil as the hosel 560 is withdrawn, until the potential points of contact 555 are sufficiently disengaged from the cavity wall 535 to achieve the desired lessened degree of contact between the potential points of contact 555 and the cavity wall 535.

The solid 532 may be made out of metal or other suitable material with sufficient resilience and flexibility to allow the solid 532 to alternately engage the cavity wall 535 and disengage from the cavity wall 535 to the desired degree. The position, configuration and number of splits in the solid 532 will depend in part on: the shape of the solid 532; the shape of the cavity 534; the flexibility, resiliency or other properties of the material used to construct the solid 532; and the desired range of shaft 12 positions that may be achieved.

Since the solid 532 need only contact the cavity wall 535 at four potential points of contact 555, and since the position of the potential points of contact 555 can be adjusted somewhat by manipulating the shaft 12, there is room for some tolerance in the size and shape of the cavity 534 and solid 532. For example, where the solid 532 is spherical and the cavity 534 is cylindrical, the cavity 534 may be drilled with a conventional drill bit despite the conically-shaped space 570 created by the leading tip of the drill bit.

The solid 532 may be retained in the cavity 534 by a retaining plug 590 fitted into the opening of the cavity 534. The retaining plug 590 may be threaded, tapped or glued into the opening of the cavity 534, and may be tightened until it just contacts the solid 532 but does not restrict its movement. Where there is only one opening, that is, where the hosel 560 and shaft 12 exit the cavity 534 from the same opening used to insert the solid 532, the retaining plug 590 will have an inner bore 590*a* to allow the hosel 560 and shaft 12 to exit the cavity 534 through the bore 590*a*. In that case it is the size of the inner bore 590*a* of the plug 590 that determines the minimum lie angle of the shaft 12. As discussed with the other embodiments, the opening through which the hosel 566 exits the cavity 534 can be made to restrict the possible angles of the shaft 12.

Optionally, the cavity 534 may be fitted with compressible, resilient pads, pads or a liner having different friction or elastic properties (not shown). For example, rubber or plastic pads may be positioned between the solid 532 and the cavity wall 535. Contact between the solid 532 and the cavity wall 535 is then made through the pads. Highly compressible pads, such as rubber, may be used to make it easier for a golfer to select a desired friction. The selection of the pad material also provides a way to adjust the friction between the solid 532 and the cavity wall 535.

Many variations in the shape of the solid 532 are possible, and it is also possible to use more than one solid 532, as long as the cavity 534, shaft 12 and solid or solids 532 are shaped and arranged to provide points of contact 555 between the cavity wall 534 and (i) the solid or solids 532 alone, or (ii) the solid or solids 532 and the shaft 12 together. For example, the solid 532 may be generally cylindrical, cubical or triangular in shape. The solid 532 may be partly split along a different plane or planes, or split into more or fewer sections 550, or not split at all, for example, where at least one potential point of contact is the tip of the shaft 12 itself protruding from the solid 532. Two or more solids 532 may be used, for example two hemispheres wherein the first hemisphere is fixedly attached to the shaft 12 and the second hemisphere is moveably attached to the shaft 12 via a threaded bore, allowing the hemispheres to be alternately brought together or moved apart by twisting the shaft 12. In such a variation the metal or other material from which the solids 532 are made need not necessarily be as resilient or elastic since the solid 532 does not bend or include a living joint.

It is also not necessary that the hosel 560 or shaft 12 and the solid 532 or solids 532 connect by means of a threaded connection 565, 566. Other connections between the hosel 560 or shaft 12 and the solid 532 or solids 532 that allow a golfer to change the position of at least one potential point of contact 555 relative to other potential points of contact 555 by manipulating the shaft 12 may also be used. For example, the shaft 12 may be tapered at one end and provided with locking tabs. The solid 532 may be partly split into sections 550 and may have a bore with locking detents. When the tapered shaft 12 is forced downward into the bore, the sections 550 of the solid 532 are wedged apart. The shaft 12 may then be locked into position by twisting it to slide the locking tabs into the locking detents. As a further example, the shaft 12 may be tapered and provided with a raised lip around its circumference. The solid 532 may be partly split into sections 550 and may have a bore with a groove. As the tapered shaft is forced downward into the bore, the sections 550 of the solid 532 are spread apart. The shaft 12 may be locked in position by snapping the raised lip into the groove.

In yet other variations, the solid 532 and cavity 534 may be configured to limit movement of the shaft 12 to rotation at a single desired lie angle or range of lie angles. For example, to restrict rotation to a single desired lie angle the hosel 560 may be connected to the solid 532 at the desired angle, and the solid 532 may be a cylinder that sits within a cylindrical cavity 534 having only a slightly larger diameter than the cylindrical solid 532. Alternatively, as described in the second embodiment, the fifth head 516 may be modified to allow a gate or retaining ring to be located at the opening where the shaft 12 exits the cavity 534. Such a gate or retaining ring may be configured to restrict the possible positions of the shaft 12. A plurality of retaining rings or gates providing a variety of minimum lies or positions may be provided to allow a golfer to use different rings as desired. As described in the third embodiment, the fifth head 516 may also be fitted with a screw that protrudes into the cavity 534 and contacts the bottom of the solid 532. The screw may function as a locking screw that, when tightened, prevents the golfer from moving the shaft 12 relative to the fifth head 516 without the use of tools. The screw may also be used in conjunction with a modified solid 532 to control the lie of the shaft 12, for example, by fashioning the modified solid 532 with a flat area that contacts the screw when the shaft 12 is at a desired angle, as described in the third embodiment.

In some versions of the fifth embodiment, for example, where residual friction on the solid 532 may be minimal, means may be required to prevent the solid 532 from rotating with the shaft 12. One such means is a pin 592 through the side of the head 516 that enters the cavity 534. The pin 592 protrudes into the splits of the solid 532. If the solid 532 is spherical, the pin 592 may point to the center of the solid 532 to provide minimum interference with the possible positions of the shaft 12.

A Sixth Embodiment

Figure 23:
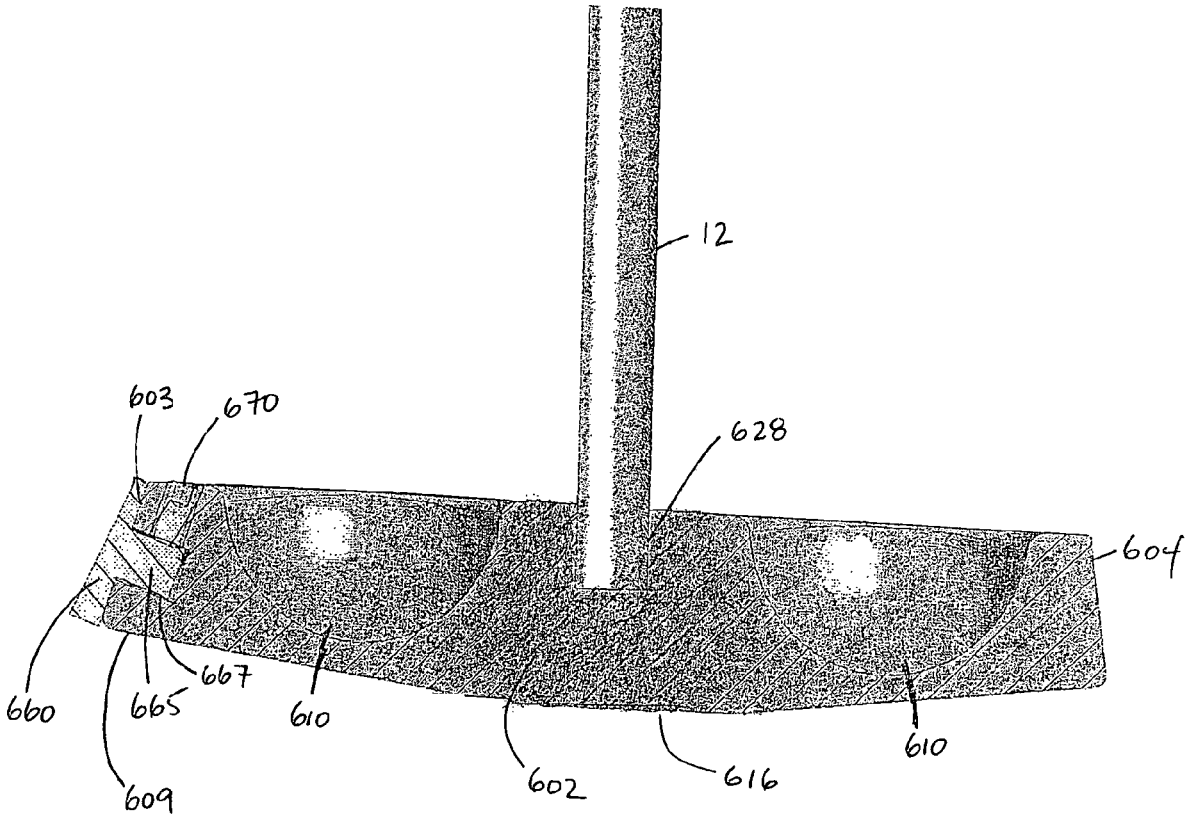
FIG. 23 is a sectioned side view of a sixth embodiment, sectioned through the center of the shaft, configured to connect with a wedge on a short side of the head.
Figure 25:
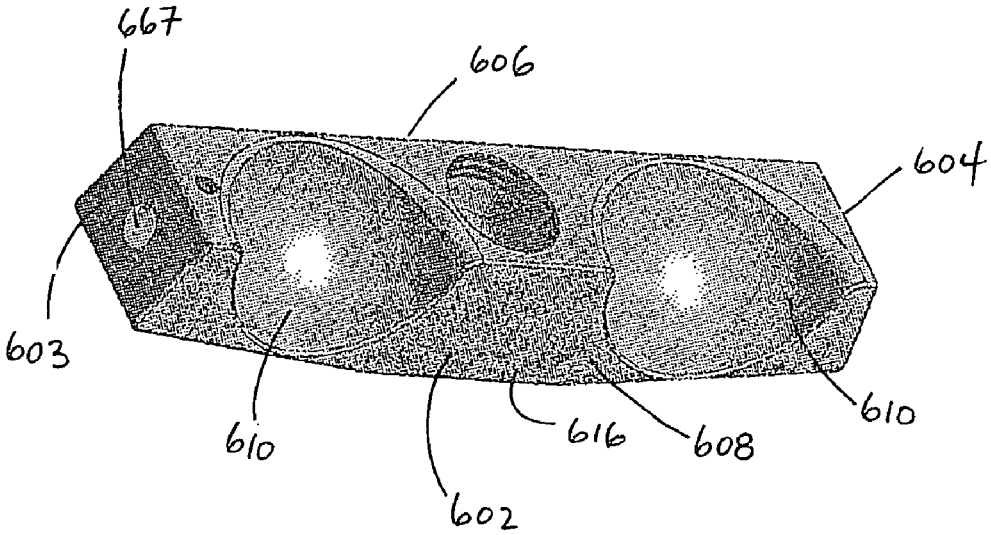
FIG. 25 is a perspective view of a sixth head, configured to connect with a wedge on a short side of the head.

FIG. 23 shows a sixth embodiment that allows a golfer to change the loft of the putting surface of the sixth head 616 even though a shaft 12 may be fixed to the sixth head 616. A sixth head 616 is shown in FIGS. 23 and 25 although any suitable head, including any of the heads 16, 116, 216, 316, 416, 516 previously described may also be used, provided they are modified as described below. The sixth head 616 has an elongated body 602, creating two short sides 603, 604 and two long sides 606, 608. The angle of the shaft 12 to the sixth head 616 is made suitable for putting at least from the short sides 603, 604. The sixth head 616 is also provided with ball scoops 610.

The shaft 12 may be fixedly attached to the sixth head 616 through a sixth connection 628. In the sixth connection 628, the shaft 12 is fixed to the head 616 at a desired lie angle for putting from the short sides 603, 604, for example by gluing, pinning or threading the shaft 12 to the sixth head 616. Optionally, the shaft 12 may be movably attached to the sixth head 616, in which case any of the connections 128, 228, 328, 528 described in previous embodiments may be used.

Figure 24:
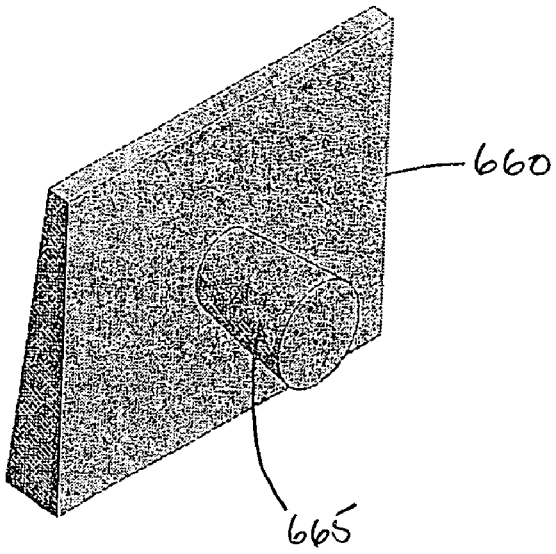
FIG. 24 is a perspective view of a wedge used in a sixth embodiment to change the loft of a putting surface.

In the sixth head 616, a wedge 660 may be affixed to a short side 603, 604 of the head 616, as shown in FIGS. 23 and 24. Optionally, the sixth head 616 may connect with a wedge 660 on a long side 606, 608 or on more than one side. The wedge 660 may be sized and configured so that a desired loft is achieved when the wedge 660 is affixed to the short side 603, 604 of the putter. The wedge 660 may be provided with one or more pegs 665 for connecting with the sixth head 616. The sixth head 616 may have one or more corresponding bores 667 marginally larger than the peg 665. The bore 667 may be fitted with resilient pads (not shown), such as rubber pads, that hold the peg 665 in place by friction when the peg 665 is inserted into the bore 667. Alternatively or additionally, a screw 670 may protrude into the bore 667 and contact the side of each peg 665. The screw 670 may be threaded, for example, into the top of the sixth head 616 (as shown in FIG. 23), or alternatively into a side 603, 604, 606, 608 or bottom 609 of the sixth head 616 and may engage a tool, such as a screwdriver head or Allen key. Optionally, the peg 665 may be shaped to prevent it from rotating and ensure that the wedge 660 is always properly aligned relative to the sixth head 616. For example, the peg 665 may be square or triangular in cross-section, or the peg 665 may be cylindrical but provided with a flat, detent or screw hole that contacts the screw 670. The putter may be provided with a plurality of wedges 660 so that a golfer may select from among a variety of different loft angles.

The wedge 660 may be shaped and configured so that it may be attached to the head in two or more orientations, for example, (a) with the thin end of the wedge 660 toward the top of the sixth head 616 achieve one loft angle, or (b) with the thick end of the wedge 660 toward the top of the sixth head 616 to achieve a different loft angle. When the wedge 660 may be attached in two or more orientations, a number of loft angles may be achievable with fewer wedges 660.

A Seventh Embodiment

Figure 27:
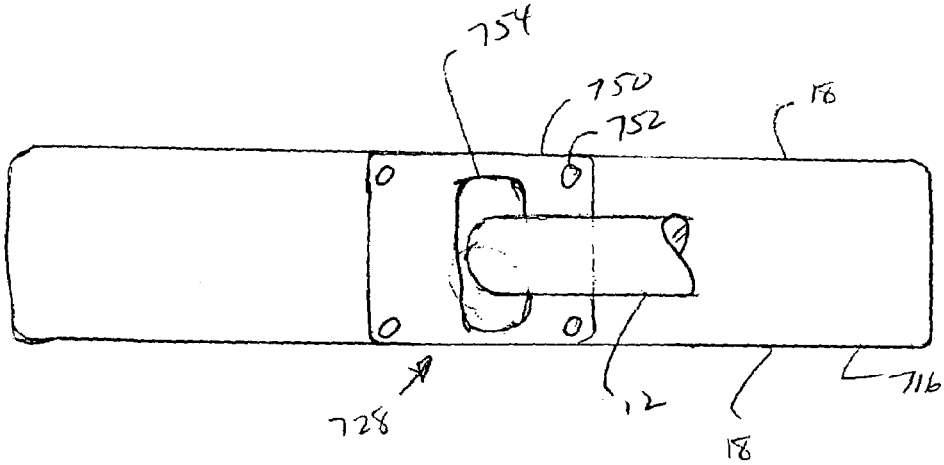
FIGS. 26 and 27 are top and sectioned elevation views of a seventh head.
Figure 26:
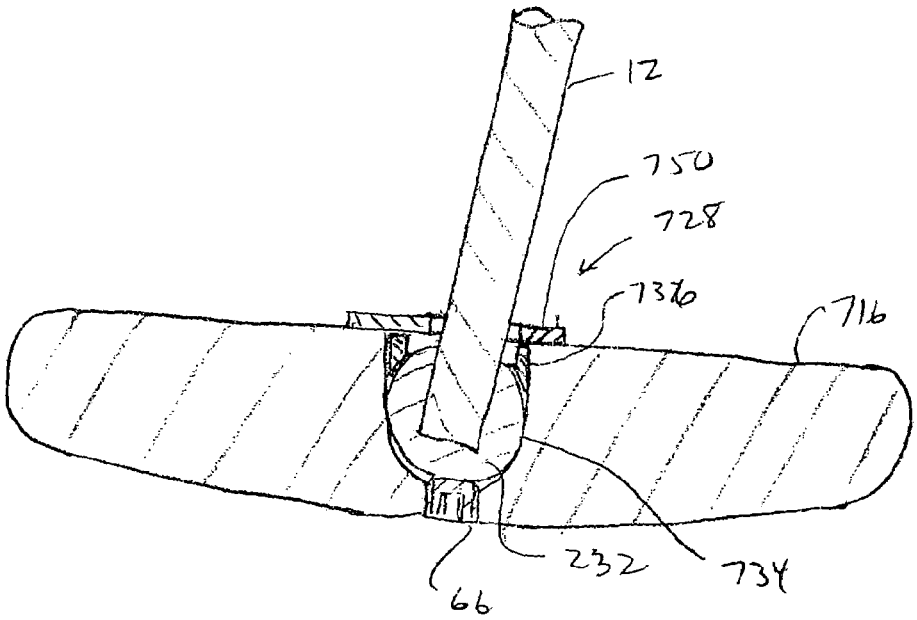

FIGS. 26 and 27 show a seventh embodiment with a seventh head 718 connected to a shaft 12 through a seventh connection 728. The seventh head 716 is shaped as for a conventional blade type putter but other head shapes may be used such as for the fifth head 512. A generally spherical ball 232 is attached to the shaft 12 as described in the second embodiment. A screw 66 is provided in the bottom of the seventh head 716 as generally described in the third embodiment. A ring 736 contacts the top of the ball 232. The ring 736 is a rotated body with a trapezoidal cross-section end provides a broad area of contact with the ball 232. The ring 736 may be made, for example, of various plastics, rubbers or silicones depending on the frictional and elastic properties desired. A plate 750 is screwed with plate screws 752 to the top of the seventh head 716. The plate 750 has a plate slot 754 through which the shaft 12 exits a seventh cavity 734. Through interference with the shaft 12, the plate 750 prevents the shaft 12 from being placed at an angle relative to the seventh head 716 that is contrary to the rules of golf. In particular, the plate slot 754 is sized, shaped and located such that the shaft 12 cannot have a lie greater than 80 degrees (or, stated alternately, be less than 10 degrees from a vertical plane perpendicular to either of two opposed and equal faces 18). The shaft 12, may also not deviate by more than 20 degrees from a vertical plane parallel to the face 18.

The size of ring 36 may be made so that, with the screw 66 fully extracted, there is either virtually no force on the ball 232 or a residual amount of force. The residual force may be such that the seventh head 716 can be moved by hand relative to the shaft 12 but remains in position when the embodiment is picked up. Alternately, the residual force may be sufficient for trial putts when experimenting with different positions of the shaft 12 but insufficient for playing an entire round. Turning the screw 66 into the seventh head 716 increases the amount of force required to change the angle of the shaft 12. With an appropriate choice of material for the ring 736 and ball 232, the screw 66 can be turned in to a point where the shaft 12 is substantially unmovable relative to the head 716 without the use of a tool. Accordingly, the shaft 12 may be fixed firmly enough to satisfy the rules of golf.

An Eighth Embodiment

Figure 29:
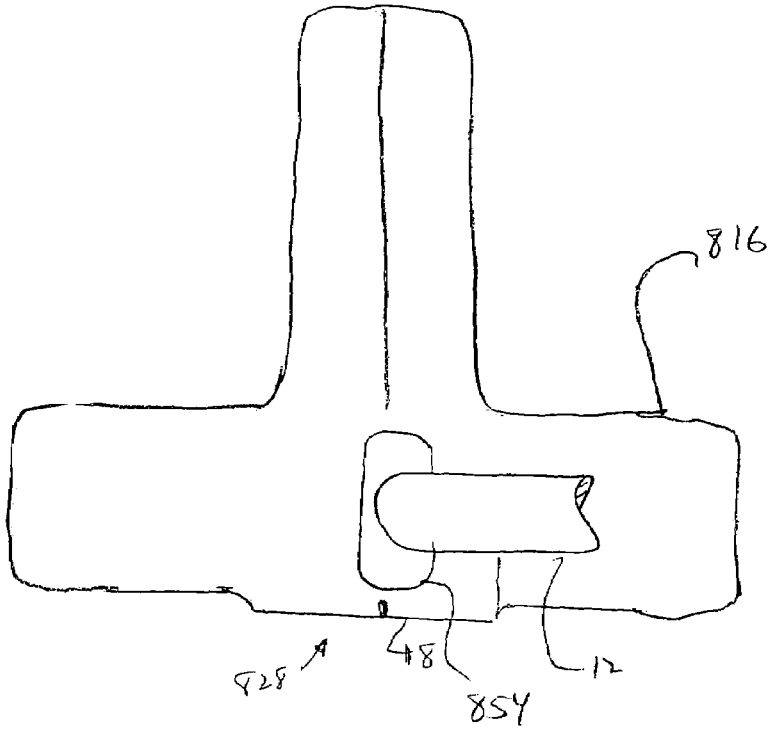
FIGS. 28 and 29 are top and sectioned elevation views of an eighth head.
Figure 28:
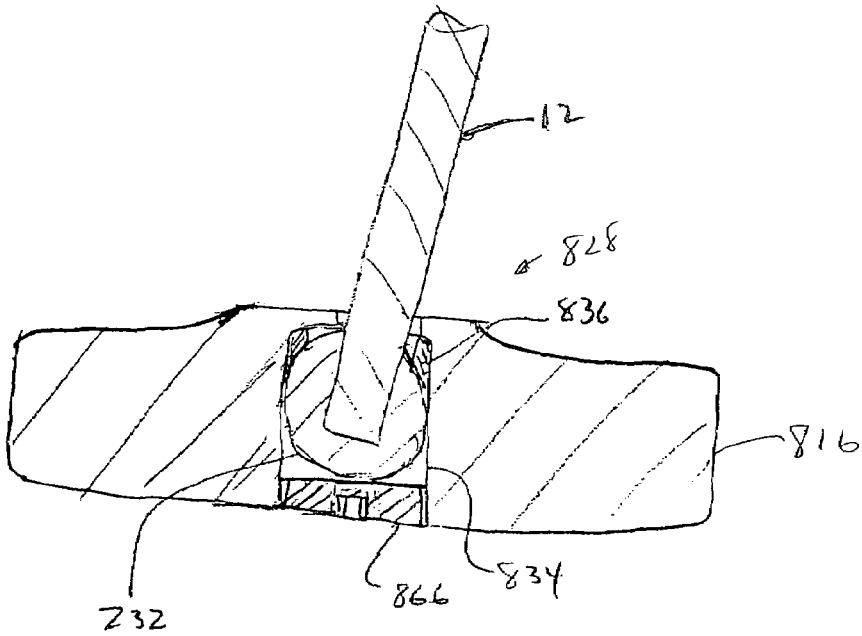

Referring to FIGS. 28 and 29, an eighth embodiment is shown having an eighth head 816 connected to a shaft 12 through an eighth connection 828. The eighth head 816 has an eighth cavity 834 opening to an eighth slot 854 which is integral with the upper surface of the eighth head 816. The eighth slot 854 constrains the movement of the shaft 12 as described for the seventh embodiment. The shaft 12 is connected to a ball 232 which can be placed in the eighth cavity 834 when an eighth screw 866 is not present. The connection between the shaft 12 and ball 232 may be made through a hosel (not shown). An eighth ring 836, similar to that describe for the seventh embodiment, is located at the top of the eighth cavity 834. Alternately, the top of the eighth cavity 834 can be shaped to receive the ball 232 and the eighth ring 836 either omitted or placed between the ball 232 and the eighth screw 866. Turning the eighth screw 866 into or out of the eighth cavity 834 alters the degree of connection between the shaft 12 and the eighth head 816 as described in the seventh embodiment.

Other embodiments of the invention may be made in other configurations and operated according to other methods within the scope of the invention. For example, and without limitation, the ball 232, 332 or solid 532 may be replaced with a cylinder and the O-rings 36 replaced with flat annular washers with some alteration to the embodiments described above. The O-rings 36 or other relevant components may also be replaced with similar items made of different materials or shapes to alter the friction characteristics. For example, other compressible, elastic materials, such as silicone, may provide similar but slightly more or less friction and different wear characteristics. Metals or plastics may significantly reduce the friction so that only the various detents, or new detents in addition to those described above, provide usable positions of the shaft 12, 412. Replacing the O-ring 36 or other relevant components with a serrated metal part could significantly increase the friction to allow a single position of the shaft to be more securely fixed. Parts to replace the O-rings 36 or other relevant components made of several materials may be provided with a putter to allow a golfer to create different levels of friction as desired. Various splines, pins, screws, keyways etc. may be added in various locations to provide detents or fixed positions. The shape and weighting of the heads 16, 116, 216, 316, 416, 516, 616 may also be modified in numerous ways to suit a golfer's taste. Features of the various embodiments may be combined to create new embodiments. For example, the shape of any of the heads may be adapted for use with any embodiment.

The invention claimed is:

1. A putter comprising, a) a head having a face and a cavity;

b) a shaft having a ball on one end, the ball being inside of the cavity;

c) a slot in the top of the cavity, the shaft exiting through the slot;

d) a ring mounted in the cavity between the ball and the cavity, wherein the ring is compressed between the top of the cavity and the ball to provide friction between the shaft and the head wherein the bottom of the ball rests directly on a screw threaded upwards into the cavity from a sole of the head and wherein the slot is perpendicular to the face and is sized, shaped and located to allow the shaft to pivot about two orthogonal axes but such that the shaft can not have a lie greater than 80 degrees.

2. The putter of claim 1 wherein the ball and the screw are each provided with a shape such that the ball and screw may interact to fix the shaft at a useful lie but permit the shaft to rotate around a generally vertical axis through the ball.

3. The putter of claim 2 wherein the screw is provided with a flat surface and the ball is provided with a flat spot.

4. The putter of claim 3 wherein the screw can be positioned to releasably fix the shaft at the useful lie but wherein pressure on the shaft can rotate the ball so that the flat spot on the ball is moved off of the flat head of the screw.

5. The putter of claim 1 wherein the screw can be tightened to effectively lock the shaft in a single position.

6. The putter of claim 1 further comprising a ball scoop in a side.

7. The putter of claim 1 wherein the hole prevents the shaft from being placed at a lie greater than 80 degrees.

8. The putter of claim 1 further comprising an element removably attached to the head to define, when attached to the head, a part of the cavity wherein, when the element is removed from the cavity, an opening is created sufficient to allow the ball to pass into or out of the cavity.

9. The putter of claim 8 wherein the element defines an upper part of the cavity and the hole passes through the element.

10. A putter comprising a shaft and a head wherein the shaft enters a cavity of the head through an opening, the opening provides a selected possible range of orientations of the shaft to the head, a solid located inside of the cavity is attached to the shaft, at least a portion of the solid or a screw threaded into the cavity can be moved to vary the degree of connection between the shaft and the head wherein the shaft may pivot about two orthogonal axes and wherein the opening is a slot perpendicular to a face of the head and is sized, shaped and located such that, through interference of the slot with the shaft, the shaft cannot have a lie greater than 80 degrees and may not deviate by more than 20 degrees from a vertical plane parallel to a horizontal line across the face.

11. The putter of claim 10 wherein a screw threaded into the cavity can be moved to vary the degree of connection between the shaft and the head.

12. A putter comprising a shaft and a head wherein the shaft enters a cavity of the head through an opening, the opening provides a selected possible range of orientations of the shaft to the head, a solid located inside of the cavity is attached to the shaft, at least a portion of the solid or a screw threaded into the cavity can be moved to vary the degree of connection between the shaft and the head wherein the shaft may pivot about two orthogonal axes and wherein the opening is sized, shaped and located such that the shaft cannot have a lie greater than 80 degrees and wherein the head comprises a removable plate and the plate comprises the opening.

* * * * *